US007190914B2

(12) United States Patent
Nihonyanagi et al.

(10) Patent No.: US 7,190,914 B2
(45) Date of Patent: Mar. 13, 2007

(54) IMAGE HEATING APPARATUS HAVING HEATER FOR EXTERNALLY HEATING FIXING ROLLER

(75) Inventors: Koji Nihonyanagi, Susono (JP); Hiroto Hasegawa, Mishima (JP); Shinji Hashiguchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 69 days.

(21) Appl. No.: 11/046,836

(22) Filed: Feb. 1, 2005

(65) Prior Publication Data

US 2005/0207770 A1 Sep. 22, 2005

(30) Foreign Application Priority Data

Feb. 3, 2004 (JP) ..... 2004-026238
Jan. 19, 2005 (JP) ..... 2005-011710

(51) Int. Cl.
*G03G 15/20* (2006.01)

(52) U.S. Cl. ..... 399/67; 399/69; 399/327; 399/71

(58) Field of Classification Search ..... 399/327, 399/67

See application file for complete search history.

(56) References Cited

U.S. PATENT DOCUMENTS 5,253,024 A 10/1993 Okuda et al. ..... 355/282
5,293,202 A 3/1994 Adachi et al. ..... 355/282
5,860,051 A 1/1999 Goto et al. ..... 399/259
5,862,435 A 1/1999 Suzumi et al. ..... 399/68
5,920,757 A 7/1999 Izawa et al. ..... 399/329
5,991,555 A 11/1999 Suzumi et al. ..... 399/18
6,085,058 A 7/2000 Goto et al. ..... 399/313
6,115,563 A 9/2000 Miyamoto ..... 399/67
6,131,010 A 10/2000 Kume et al. ..... 399/333
6,175,699 B1 1/2001 Kato et al. ..... 399/69
6,185,383 B1 2/2001 Kanari et al. ..... 399/45
6,263,172 B1 7/2001 Suzuki et al. ..... 399/67

(Continued)

FOREIGN PATENT DOCUMENTS

JP 8-129313 5/1996

(Continued)

*Primary Examiner*—David M. Gray
*Assistant Examiner*—Ryan D. Walsh
(74) *Attorney, Agent, or Firm*—Fitzpatrick, Cella, Harper & Scinto

(57) ABSTRACT

The image heating apparatus for heating a toner image formed on a recording material, includes a rotatable member; heating device for heating an outer peripheral surface of the rotatable member, the heating device including a heater for forming a heating nip portion in cooperation with the rotatable member; back-up device for forming a conveying nip portion in cooperation with the rotatable member, the conveying nip portion conveying the recording material; and control device for controlling a temperature of the heater and a rotation of the rotatable member; wherein the apparatus has a cleaning mode to remove toner from the heating device, wherein the control device, in the cleaning mode, starts energizing the heater to dissipate heat in a condition that the rotatable member stops and afterward stops energizing the heater, and wherein the control device rotates the rotatable member until a part which forms a heating nip portion in a peripheral direction of the rotatable member reaches the conveying nip portion. By the virtue of the present invention, it prevents stain caused by the off-set of toner the recording material in an image heating apparatus.

12 Claims, 10 Drawing Sheets

U.S. PATENT DOCUMENTS

| | | | | |
|---|---|---|---|---|
| 6,298,213 | B1 | 10/2001 | Miyamoto et al. | 399/320 |
| 6,336,009 | B1 | 1/2002 | Suzumi et al. | 399/67 |
| 6,456,819 | B1 | 9/2002 | Abe et al. | 399/329 |
| 6,477,348 | B2 | 11/2002 | Miyamoto et al. | 399/299 |
| 6,493,521 | B2 | 12/2002 | Miyamoto et al. | 399/44 |
| 6,505,027 | B2 | 1/2003 | Takeuchi et al. | 399/328 |
| 6,516,166 | B2 | 2/2003 | Sakakibara et al. | |
| 6,564,033 | B2 | 5/2003 | Zhou et al. | 399/329 |
| 6,580,883 | B2 | 6/2003 | Suzumi et al. | 399/69 |
| 6,597,888 | B1 | 7/2003 | Abe et al. | 399/329 |
| 6,674,978 | B1 | 1/2004 | Suzuki et al. | 399/67 |
| 6,704,537 | B2 | 3/2004 | Takeuchi et al. | 399/328 |
| 6,763,205 | B2 | 7/2004 | Izawa et al. | 399/69 |
| 6,775,509 | B2 | 8/2004 | Shida et al. | 399/328 |
| 6,782,230 | B2 | 8/2004 | Yaomin et al. | 399/326 |
| 6,792,240 | B2 | 9/2004 | Shida et al. | 399/333 |
| 6,925,271 | B2 | 8/2005 | Suzuki et al. | 399/69 |
| 6,937,837 | B2 | 8/2005 | Takeuchi et al. | 399/328 |
| 6,947,699 | B2 | 9/2005 | Suzuki et al. | 399/329 |
| 6,952,538 | B2 | 10/2005 | Hashiguchi et al. | 399/45 |
| 2003/0118363 | A1* | 6/2003 | Izawa et al. | 399/69 |
| 2004/0114975 | A1 | 6/2004 | Sano et al. | 399/328 |
| 2004/0202497 | A1 | 10/2004 | Hotta et al. | 399/328 |
| 2005/0180788 | A1 | 8/2005 | Watanabe et al. | 399/328 |
| 2005/0191075 | A1 | 9/2005 | Kimizuka et al. | 399/69 |
| 2005/0207770 | A1 | 9/2005 | Nihonyanagi et al. | 399/67 |
| 2005/0244200 | A1 | 11/2005 | Kanamori et al. | 399/333 |

FOREIGN PATENT DOCUMENTS

| | | |
|---|---|---|
| JP | 8-220920 | 8/1996 |
| JP | 10-69176 | 3/1998 |
| JP | 10-149049 | 6/1998 |
| JP | 2002-123117 | 4/2002 |
| JP | 2002-221219 | 8/2002 |
| JP | 2002-236426 | 8/2002 |
| JP | 2003-29563 | 1/2003 |
| JP | 2003-182367 | 7/2003 |
| JP | 2003-186327 | 7/2003 |
| JP | 2003-270985 | 9/2003 |

* cited by examiner

IMAGE HEATING APPARATUS HAVING HEATER FOR EXTERNALLY HEATING FIXING ROLLER

BACKGROUND OF THE INVENTION

1. Field of the Invention

The present invention relates to an image heating apparatus for heating a toner image formed on a recording material, and more particularly to an image heating apparatus adapted for use as a fixing apparatus to be mounted on an image forming apparatus such as a copying apparatus or a printer.

2. Related Background Art

As a fixing apparatus equipped in an image forming apparatus of electrophotographic process or electrostatic recording process, there has been widely employed a heat fixing device of so-called heat roller type, in which a recording material bearing an unfixed toner image is passed through a nip portion formed by a fixing roller and a pressure roller which are rotated in a mutually pressed state, thereby fixing the unfixed toner image onto the recording material as a permanent image.

On the other hand, a reduction in the electric power consumption is strongly desired as a recent environmental issue while a high image quality and a high speed in the image output are requested from market demands. Thus, various improvements are being tried in the heat fixing apparatus of the aforementioned heat roller type, in order to meet such requirements for the decreased electric power consumption and for the high image quality and the high speed.

The present applicant has proposed, in Japanese Patent Application Laid-Open No. 2003-182367, an image heating apparatus capable, as a fixing apparatus, of achieving an image output with a high image quality at a high speed, while maintaining a reduced electric power consumption and a shortened heating time. This fixing apparatus, as shown in FIG. 10, is provided with a fixing roller 20 having an elastic layer 22, a heating member 24 in contact with an external surface of the fixing roller 20 thereby forming a heating nip N, and a pressure member 30 maintained in a pressurized contact with the fixing roller thereby forming a fixing nip portion (conveying rip portion) M, in which a recording material P bearing an unfixed toner image t is pinched and conveyed to achieve heat fixation (apparatus of this type being hereinafter called "external heating type").

Also a heater 26 equipped on the heating member 24 is of a plate shape of a low heat capacity, of such a type generating heat in sliding contact with the heating nip N. Such configuration allows to achieve a higher energy density at the heating nip N in comparison with a structure of heating the surface of the heating roller by a heat roller in contact with the surface of the fixing roller, thereby enabling to promptly heating the surface of the fixing roller.

Also the contact of the elastic member 22 of the fixing roller with the recording material P or the toner t is equivalent to that in a heat roller type having an elastic layer, as employed in a prior high-speed apparatus, so that a high image quality can be maintained even for a higher speed in the image forming apparatus. Thus, such system is capable of simultaneously satisfying all the requirements, such as a reduction in the start-up time, a reduction in the electric power consumption, and a high-quality image output in a high-speed operation.

However, in the fixing apparatus shown in FIG. 10, in the heat fixation of a recording material, the toner on the recording material may be offset to the fixing roller, and such offset toner is deposited onto the surface of the heating member by the frictional contact between the heating member and the fixing roller. As the heat fixing operation is repeated, such offset toner is accumulated on the surface of the heating member, and, upon exceeding a certain amount, is peeled from the surface of the heating member and transferred onto the recording material thereby forming an image defect.

SUMMARY OF THE INVENTION

The present invention has been made in consideration of the aforementioned drawbacks, and an object of the present invention is to provide an image heating apparatus capable of suppressing a stain on the recording material, caused by a toner offset to the image heating apparatus.

Another object of the present invention is to provide an image heating apparatus of external heating type, capable of suppressing an accumulation of the toner deposited onto heating means of such image heating apparatus.

Still another object of the present invention is to provide an image heating apparatus for heating a toner image formed on a recording material, including a rotatable member; heating means which heats an outer peripheral surface of the rotatable member, the heating means including a heater for forming a heating nip portion in cooperation with the rotatable member; back-up means which forms a conveying nip portion in cooperation with the rotatable member, the conveying nip portion conveying the recording material; and control means which controls a temperature of the heater and a rotation of the rotatable member; wherein the apparatus has a cleaning mode to remove toner from the heating means, wherein the control means, in the cleaning mode, starts energizing the heater to dissipate heat in a condition that the rotatable member stops and afterwards stops energizing the heater, and wherein the control means rotates the rotatable member until a part which forms a heating nip portion in a peripheral direction of the rotatable member reaches the conveying nip portion.

Still other objects of the present invention will become fully apparent from the following detailed description to be taken in conjunction with the accompanying drawings.

DESCRIPTION OF THE PREFERRED EMBODIMENTS

In the following, embodiments of the present invention will be explained with reference to the accompanying drawings.

First Embodiment (1) Example of Image Forming Apparatus

Figure 1:
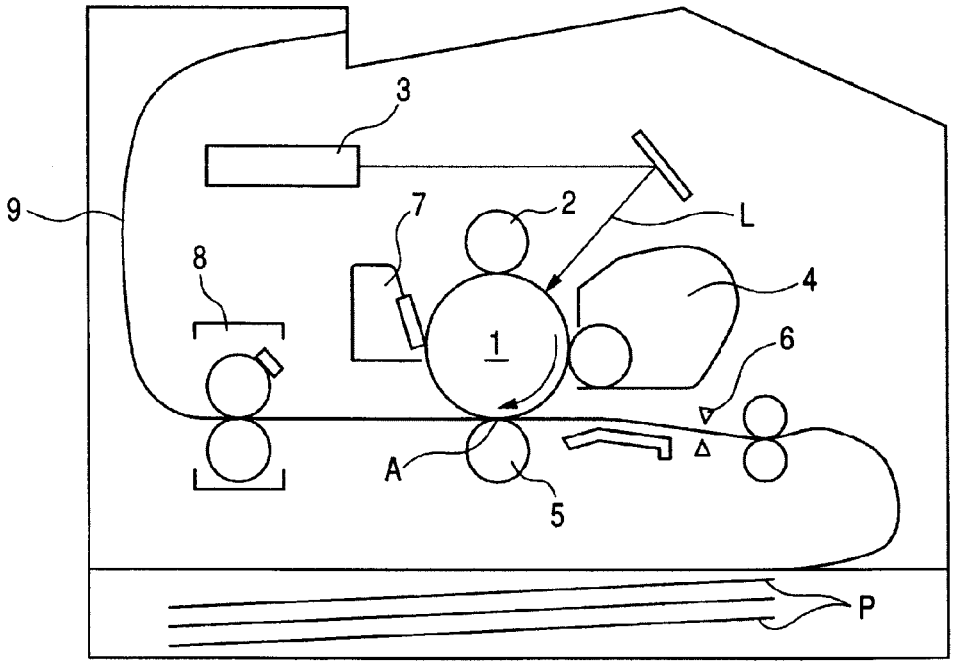
FIG. 1 is a schematic view showing a configuration of an image forming apparatus.

FIG. 1 is a schematic view showing a configuration of an image forming apparatus. The image forming apparatus of the present embodiment is a laser beam printer utilizing an electrophotographic process of transfer type.

An electrophotographic photosensitive member of a rotary drum shape (hereinafter called photosensitive drum) serving as an image bearing member is constituted of a photosensitive material such as an OPC, amorphous Se or amorphous Si formed on a cylindrical substrate such as of aluminum or nickel.

The photosensitive drum 1 is rotated with a predetermined peripheral speed clockwise as indicated by an arrow, and a surface thereof is at first uniformly charged at predetermined polarity and potential by a charging roller 2 serving as a charging apparatus.

Then the charged surface is subjected to an exposure corresponding to image information by a laser scanner 3. The laser scanner 3 irradiates the uniformly charged surface of the rotary photosensitive drum 1 with a laser beam L which is on/off controlled (modulation control) according to a time-sequential electrical digital image signal of image information. Thus the potential of the uniformly charged surface of the photosensitive drum 1 is attenuated in an exposed portion, whereby an electrostatic latent image is formed corresponding to the image information, on the photosensitive drum.

The electrostatic latent image is developed and rendered visible as a toner image in a developing apparatus 4. Such development can be executed for example by a jumping development, a two-component development or a FEED development, and an imagewise exposure and a reversal development are often employed in a combination.

The visible toner image is transferred, at a transfer nip portion A formed by a pressed contact of the photosensitive drum 1 and a transfer roller 5 constituting a contact transfer apparatus pressed thereto, from the surface of the photosensitive drum 1 onto a surface of a recording material P which is supplied at a controlled timing from a sheet feeding mechanism 6 to the transfer nip portion.

More specifically, a timing of conveying of the recording material is controlled according to front end position information of the recording material P, detected by a sensor 7 in such a manner that the toner image on the photosensitive drum 1 coincides with a writing start position at the front end of the recording material. The recording material P conveyed at a predetermined timing is, at the transfer nip portion A, pinched and conveyed under a predetermined pressure by the photosensitive drum 1 and the transfer roller 5 whereby the toner image on the surface of the photosensitive drum 1 is transferred onto the recording material P by an electrical force and a pressure.

The recording material P, upon passing through the transfer nip portion A, is separated from the surface of the photosensitive drum 1 and conveyed to a heat fixing apparatus 9, in which the unfixed toner image is heat fixed as a permanent image on the surface of the recording material. The recording material subjected to image fixation is conveyed to a sheet discharging mechanism 10.

A transfer residual toner, remaining on the photosensitive drum 1 after the separation of the recording material, is removed by a cleaning apparatus 8 from the surface of the photosensitive drum 1, which is then used in image formation in repetition.

(2) Operation Sequence of Printer

In the following, an operation sequence of the above-described printer will be explained with reference to FIG. 2.

A: Pre multi-rotation step: This is a starting operation period (starting operation period or warming-up period) of the printer. In response to a turning-on of a main switch of the apparatus, a main motor of the apparatus is driven to rotate the photosensitive drum thereby executing preparatory operations for predetermined process devices.

B: Initial rotation step: This is a period for executing a pre-print operation. In case a print signal is entered during the pre multi-rotation step, this initial rotation step is executed in succession to the pre multi-rotation step. In case a print signal is not entered, the main motor is once deactivated to terminate the rotation of the photosensitive drum 1, and the printer is maintained in a stand-by (waiting) state until a print signal is entered. The initial rotation step is executed in response to an entry of a print signal.

C: Printing step (image formation step, imaging step): After the predetermined initial rotation step, there are executed an image formation step on the photosensitive drum 1, a transfer of the toner image formed on the photosensitive drum 1 onto the recording material P, and a fixing process for the toner image by the fixing means, whereupon a formed image is output. In a continuous print mode, the aforementioned printing step is repeatedly executed by a preset print number.

D: Sheet interval step: This is a sheet non-passing period in the transfer nip portion A, in a continuous printing mode, from a passing of a rear end of a recording material P through the transfer nip portion A to an arrival of a front end of a succeeding recording material P at the transfer nip portion A.

E: Post-rotation step: This is a period in which the main motor is maintained active to continue the rotation of the photosensitive drum 1 for a while after the end of the printing step for a last recording material P, in order to execute a predetermined post-operation.

F: Cleaning step (cleaning sequence): This is a period in which an offset toner, accumulated in the heating nip portion between the fixing roller and the heating member in the heat fixing apparatus 8, thereby cleaning the heating member. The cleaning step will be detailedly explained in the following.

G: Stand-by: After the end of the predetermined post-rotation step, the main motor is deactivated to terminate the rotation of the photosensitive drum 1, whereby the printer is maintained in a stand-by state until a next print start signal is entered.

In case of a single print only, the printer enters the stand-by state after executing the post-rotation step. In the stand-by state, the printer enters the initial rotation step upon receiving a print start signal.

The printing step C constitutes an image forming period, while the pre multi-rotation step A, the initial rotation step B, the sheet interval step D, the post-rotation step E and the cleaning step F constitute an image non-forming period (image non-formation state).

The main motor drives the photosensitive drum 1, the sheet feeding mechanism 6, the developing apparatus 4, the transfer apparatus 5, the heat fixing apparatus 9 and the sheet discharge mechanism 10.

(3) Heat Fixing Apparatus

Figure 3:
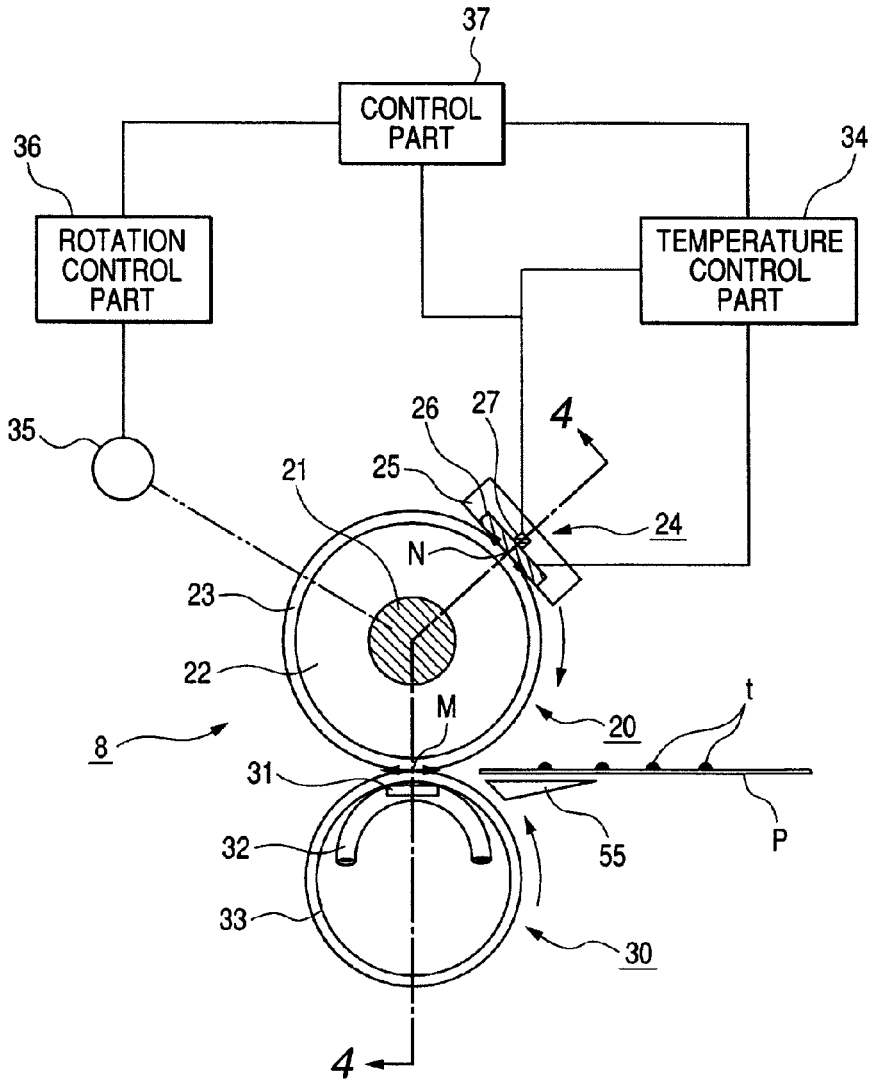
FIG. 3 is a schematic view showing a configuration of a heat fixing apparatus in the embodiment 1.
Figure 4:
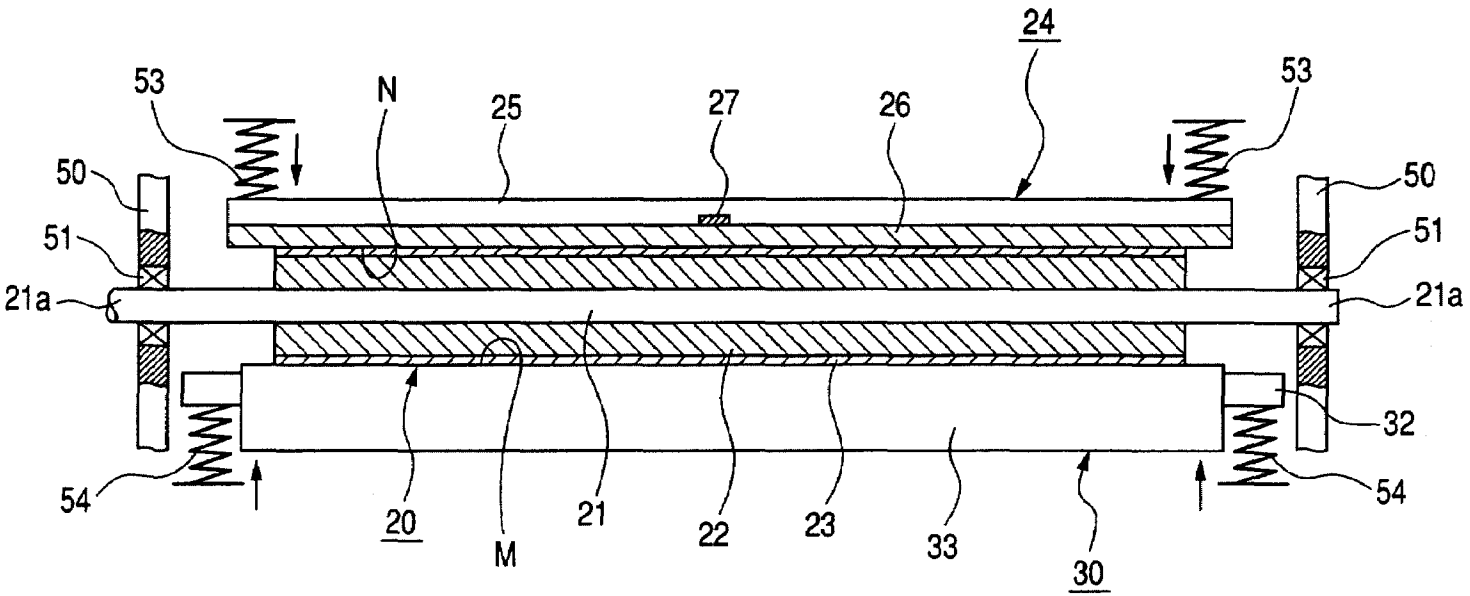
FIG. 4 is a schematic cross-sectional view of the heating fixing apparatus shown in FIG. 2, along a line B—B therein.

FIG. 3 is a schematic view of the heat fixing apparatus 6 of the present embodiment, and FIG. 4 is a schematic view of the heat fixing apparatus shown in FIG. 3 along a line B—B therein.

The heat fixing apparatus is principally provided with a fixing roller (rotatable member) 20 having an elastic layer, a heating member (heating means) 24 maintained in contact with an external surface (external periphery) of the fixing roller 20 to form a heating nip portion N thereby heating and causing a temperature elevation on the external surface of the fixing roller 20, and a pressure member (backup means) 30 in a mutual pressurized contact with the fixing roller 20 thereby forming a fixing nip portion (conveying nip portion) M.

1) Fixing Roller (Rotatable Member) 20

The fixing roller 20 is constituted of following members. It is basically constituted by forming, on an external surface or an external periphery of an aluminum or iron metal core 21, an elastic layer 22 (solid rubber layer) formed by silicone rubber, or an elastic layer (sponge rubber layer) formed by foaming silicone rubber for providing a heat insulating effect, or an elastic layer (bubbled rubber layer) formed by dispersing bubbles within a silicone rubber layer by any method thereby increasing the heat insulating effect.

However, the fixing roller, in case having a large heat capacity and also even a slightly large thermal conductivity, tends to absorb the heat received from the external surface whereby the surface temperature of the fixing roller cannot be easily elevated. For this reason, the elastic layer 22 is advantageously formed by a material of a low heat capacity, a low thermal conductivity and a high heat insulating effect as far as possible, in order to shorten a time required by the surface temperature of the fixing roller to reach a predetermined temperature.

The thermal conductivity is 0.25 to 0.29 W/m·K in silicone solid rubber, while that in sponge rubber and bubbled rubber is 0.11 to 0.16 W/m·K, namely about a half of that in the solid rubber.

Also a specific gravity, relating to the heat capacity, is about 1.05 to 1.30 in the solid rubber while it is about 0.75 to 0.85 in the sponge rubber or in the bubbled rubber.

Therefore, the elastic layer 22 is preferably constituted of a sponge rubber layer or a bubbled rubber layer of a high heat insulating effect, having a thermal conductivity of about 0.15 W/m·K or less and a specific gravity of 0.85 or less.

Also in the fixing roller 20, a smaller external shape (external diameter) allows to suppress the heat capacity, but a certain diameter is necessary since the heating nip N becomes difficult to form at an excessively small diameter.

Also in the elastic layer 22, a certain appropriate thickness is necessary as an excessively thin layer stimulates heat dissipation to the metal core 21.

In consideration of the foregoing, the present embodiment employs an elastic layer 22 formed with a bubbled rubber of a thickness of 4 mm and a fixing roller 20 with an external diameter of 20 mmϕ in order to form an appropriate heating nip N and to suppress the heat capacity.

On the aforementioned elastic layer 22, there is formed a releasing layer 23 of a fluorinated resin such as perfluoroalkoxy resin (PFA), polytetrafluoroethylene (PTFE) or tetrafluoroethylene-hexafluoropropylene resin (FEP). The releasing layer 23 may be formed as a tube or formed by coating, but a tube is superior in durability.

The fixing roller 20 of the aforementioned configuration is rotatably supported, at both ends 21*a* of the metal core 21, by bearings 51 on a pair of roller support members 50 as shown in FIG. 4.

2) Heating Means 24

The heating means 24 is constituted of following members. A plate-shaped heater (heating member) 26 of a low heat capacity is maintained, at a surface at the side of the fixing roller 20, in contact with the external surface of the fixing roller 20, thereby heating the external surface thereof. The heater 26 is constituted by forming, on a surface of a highly insulating ceramic substrate such as of alumina or aluminum nitride, a heat-generating resistor layer such as of Ag/Pd (silver-palladium), $RuO_2$ or $Ta_2N$ for example by screen printing along a longitudinal direction. The heat-generating resistor layer has a line or stripe shape with a thickness of about 10 μm and a width of about 1 to 5 mm.

On the surface of the heater 26, there is preferably formed a protective slidable layer in order to avoid an abrasion of the releasing layer 23 of the fixing roller 20 by friction. The protective layer can be formed, for example, by coating a fluorinated resin such as perfluoroalkoxy resin (PFA), polytetrafluoroethylene resin (PTFE), tetrafluoroethylene-hexafluoropropylene resin (FEP), polychlorotrifluoroethylene resin (CTEF) or polyvinylidene fluoride (PVDF) singly or in a mixture, a dry film lubricant constituted, for example of graphite, diamon-like carbon (DLC) or molybdenum disulfide, or a glass coating.

A heat insulating stay holder 25 is provided for supporting the heater 26. The heat insulating stay holder 25 is pressed, at both ends thereof as shown in FIG. 4, toward the fixing roller 20 by pressurizing means (such as coil springs) 53, and a heating nip portion N is formed by such pressure between the heater 26 and the fixing roller 20. The heat insulating stay holder 25 has a function of preventing heat dissipation in a direction opposite to the heating nip portion N, and can be formed for example with a liquid crystal polymer, phenolic resin, PPS, or PEEK.

On the rear surface of the heater 26, there is provided a temperature detector (temperature detection means) 27 such as a thermistor for detecting the temperature of the ceramic substrate heated by the heat generated in the heat-generating resistor layer. In response to a signal from the temperature detector 27, a temperature controller (temperature control means) 34 shown in FIG. 3 suitably controls a duty ratio or a frequency of a voltage applied to the heat-generating resistor layer from unillustrated terminals provided on both ends thereof, thereby achieving a temperature control of the heater 26. More specifically, the temperature controller 34 so controls the current supply to the heater 26 that the temperature detected by the temperature detector 27 is maintained at a set temperature. In the fixing apparatus of the present embodiment, the temperature control of the heater 26 allows to maintain, within the surface of the fixing roller 20, a surface portion thereof moving from the heat nip portion N toward the conveying nip portion M at a temperature suitable for fixing. A DC current supply from the temperature detector 27 to the temperature controller 34 is achieved by an unillustrated DC power supply and DC electrodes, across an unillustrated connector.

3) Pressurizing Member (Backup Means) 30

The pressurizing member 30 has a following configuration. A sliding film (flexible sleeve) 33 of a cylindrical shape is constituted of a resinous film having a heat-resistant and thermoplastic base layer for example of polyimide, polyamidimide, PEEK, PPS, PFA, PTFE or FEP. An appropriate thickness range of the film is equal to or larger than 20 μm but smaller than 150 μm, in consideration of the strength. An external shape (external diameter) of the sliding film is made smaller than the external shape of the fixing roller 20.

There are also provided a slidable plate (slidable member) provided inside the sliding film 33, and a heating insulating stay holder 32 supporting the slidable plate 31.

The heat insulating stay holder 32 is pressed, at both ends thereof as shown in FIG. 4, toward the fixing roller 20 by pressurizing means (such as coil springs) 54, and a fixing nip portion (conveying nip portion) M is formed between the heater 26 and the fixing roller 20, across the sliding film 33. The heat insulating stay holder 32, as in case of the stay holder 25 for the heating member 24, is formed by a heat-insulating and heat-resistant resin such as a liquid crystal polymer, phenolic resin, PPS, or PEEK. Therefore, the sliding film 33 is in contact, at the internal peripheral surface thereof, with the slidable plate 31 and, at the external peripheral surface thereof, with the external periphery of the fixing roller 20.

The slidable plate 31 is formed with a material showing a low friction with the sliding film 33 and having a heat insulating property, such as a liquid crystal polymer, phenolic resin, PPS or PEEK as in the case of the stay holder 32, and is preferably coated, on the surface thereof, with a slidable layer for reducing the friction resistance. Examples of such layer is similar to those of the slidable layer provided on the surface of the heater 26, and will not, therefore, be explained further.

In the present embodiment, the slidable plate 31 and the heat insulating stay holder 32 are constructed as separate members, but it is also possible to integrally form these members and to coat the aforementioned slidable layer in a sliding contact part, thereby achieving a further cost reduction. Also between the sliding film 33 and the slidable plate 31, a small amount of lubricant such as grease, in order to reduce the friction resistance between the sliding film 31 and the slidable plate 31.

As the present embodiment adopts a fixing roller with a diameter ϕ of 20 mm, an angle of 120° between a line connecting the center of the fixing roller 20 and the center of the heating nip portion N and a line connecting the center of the fixing roller 20 and the center of the fixing nip portion M, and a conveying speed of 250 mm/sec of the recording material, a time required by the surface of the fixing roller 20 to move from the center of the heating nip portion N to the center of the fixing nip portion M is as short as 0.08 seconds. Besides, as the elastic layer 22 of the fixing roller 20 is composed, as explained in the foregoing, of a sponge rubber layer or a bubbled rubber layer of a thermal conductivity of about 0.15 W/m·K or less and a specific gravity of 0.85 or less, the surface area of the fixing roller, heated by the heater 26 in the heating nip portion N, can reach the fixing nip portion M almost without a temperature loss.

4) Operation

In such configuration, the fixing roller 20 is rotated, through the longitudinal end and the metal core 21 thereof, by the main motor (drive means) 35 of the apparatus shown in FIG. 3, in a clockwise direction indicated by an arrow (conveying direction of the recording material). The main motor 35 is controlled by a rotation controller 36. Also the temperature controller 34 and the rotation controller 36 are managed by a control unit 37. By the rotation of the fixing roller 20, the sliding film 33 at the side of the backup means 30 receives a rotating force at the fixing nip portion M and is driven counterclockwise outside the heat insulating stay holder 32 in sliding contact with the surface of the slidable plate 31.

Also a current is supplied to the heat generating resistor layer of the heater 26 of the heating means 20 to promptly heat the heater 26 to a predetermined control temperature (set temperature), and a temperature control system including the temperature detector 27 and the temperature controller 34 controls the current supply to the heat generating resistor layer in such a manner that the heater 26 is maintained at a predetermined control temperature.

Also by the heat generation of the heater 26, the external surface of the rotating fixing roller 20 is externally heated at the heating nip portion N and is rapidly heated to the predetermined fixing temperature. In the fixing apparatus, as explained above, the temperature control of the heater 26 allows to maintain, within the surface of the fixing roller 20, a surface portion thereof moving from the heat nip portion N toward the conveying nip portion M at a temperature suitable for fixing.

In a state where the fixing roller 20 is rotated and the external surface thereof is heated to the predetermined fixing temperature, a recording material P bearing an unfixed toner image is introduced, from the side of the transfer nip portion A and along a heat resistant fixing entrance guide 55, into the fixing nip portion M formed by the fixing roller 20 and the pressure roller 30, and is pinched and conveyed by the fixing nip portion M. Thus the unfixed toner image t is fixed, by heat and pressure in the fixing nip portion M, onto the recording material P.

Figure 5:
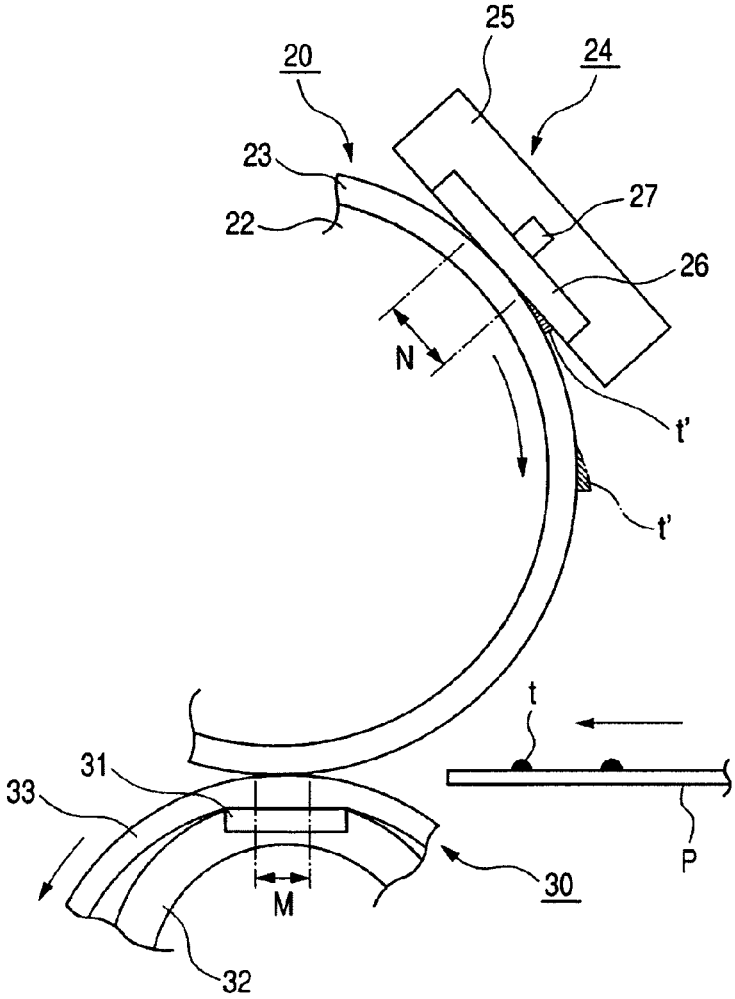
FIG. 5 is a magnified view of a heating nip portion shown in FIG. 2.

In the heat fixing operation of the unfixed toner image by pinching and conveying the recording material P in the fixing nip portion M, a small amount of offset toner, coming from the recording material P, is accumulated on a portion of the heater 26 in the heating nip portion N. This phenomenon will be explained with reference to FIG. 5, which is a magnified view of the heating nip portion N formed by the pressed contact of the heater 26 and the fixing roller 20. The offset toner t of the small amount on the fixing roller 20 is at first blocked at the upstream side of the heating nip portion N in the rotating direction of the fixing roller. However, most of the toner blocked at the upstream side of the heating nip portion N is then fused by heating and gradually moves, along with the rotation of the fixing roller 20, through the contact portion of the heater 26 and the fixing roller 20 in the heating nip portion N toward the downstream side of the heating nip portion N in the rotating direction of the fixing roller, and is accumulated on the surface of the heater 26 after the heating nip portion N, as indicated by t'. When the printing operation is continued in this state, the accumulated toner t' is sooner or later returned onto the surface of the fixing roller 20, then transported to the fixing nip portion M and is transferred onto a surface (image printing surface) of the recording material, thereby staining the recording material P.

5) Control Mode (Cleaning Mode)

Figure 6:
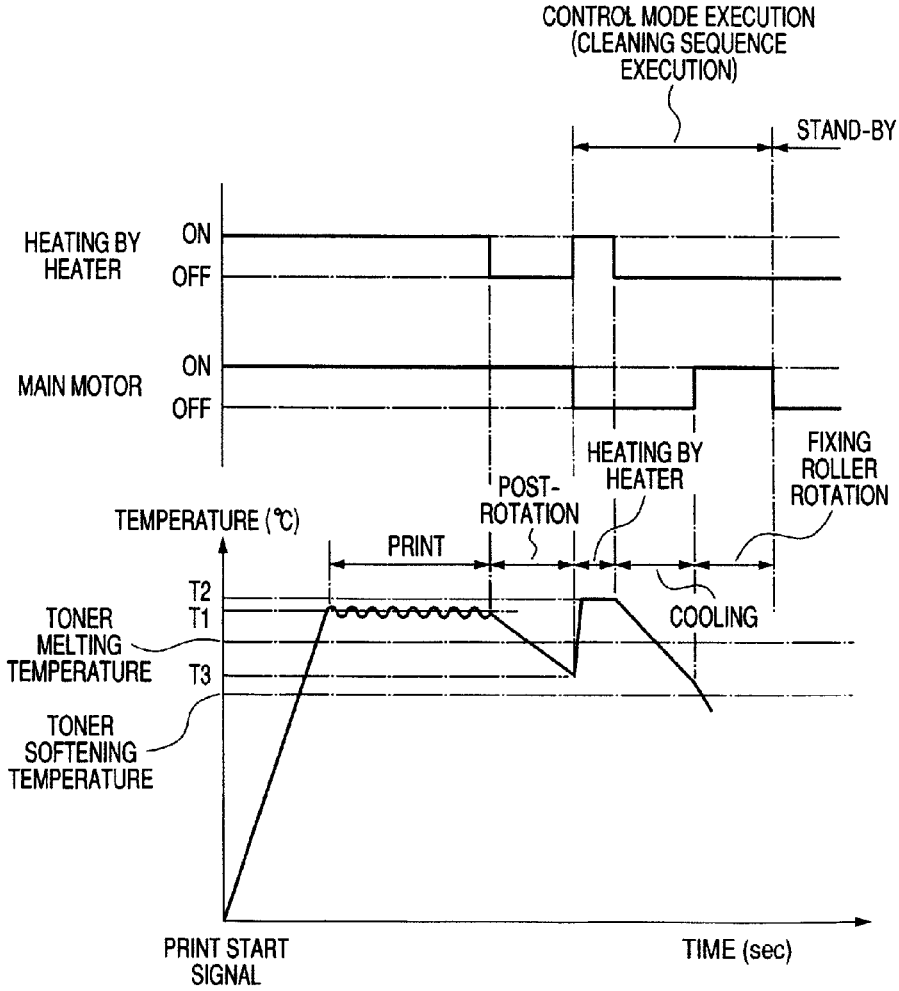
FIG. 6 is a schematic view showing a temperature control of a heater in a control mode, a temperature behavior of the heater, and a rotation control of a fixing roller.

In the present embodiment, therefore, the heater 26 is turned off simultaneously with the end of the printing operation, and, after the post-rotation step explained in the foregoing, there is executed a control mode (cleaning sequence) for cleaning the heater 26 by a controller 37 shown in FIG. 3. (Thus, the cleaning mode in the present embodiment is automatically executed after the heating step for heating the toner image on the recording material is completed.) FIG. 6 schematically shows a temperature control for the heater 26 in case of the aforementioned control mode, a temperature behavior of the heater 26 and a rotation control for the fixing roller 20.

When the control mode is started, the rotation controller 36 turns off the main motor 35 to stop the rotation of the fixing roller 20, and, in this state, the temperature controller 34 turns on a current supply to the heat-generating resistor layer of the heater 26, thereby initiating a control for heating the heater 26 to a predetermined temperature T2 higher than the fusing temperature of the toner and maintaining such temperature T2. Such heating mutually combines the toners deposited at the downstream side of the heating nip portion N. The control of maintaining the temperature of the heater 26 (namely, temperature detected by the temperature detector 27) at T2 is conducted for a period required for the mutual combining of the toner t', and the current supply to the heat-generating resistor layer is thereafter turned off. The fixing roller 20 of the present embodiment, having an elastic layer 22 of a low heat capacity and a high heat-insulating effect, shows a surface temperature lower than the temperature of heater 26 with a lapse of time after the current supply to the heater 26 is turned off. Therefore the toner t', combined in the heating nip portion N and in the vicinity of exit thereof, is cooled by thus cooling fixing roller 20 and starts to stick to the fixing roller 20. Thus, the toner t', combined in the heating nip portion N and in the vicinity of exit thereof, becomes easily separable from the surface of the heater 26.

Figure 7A:
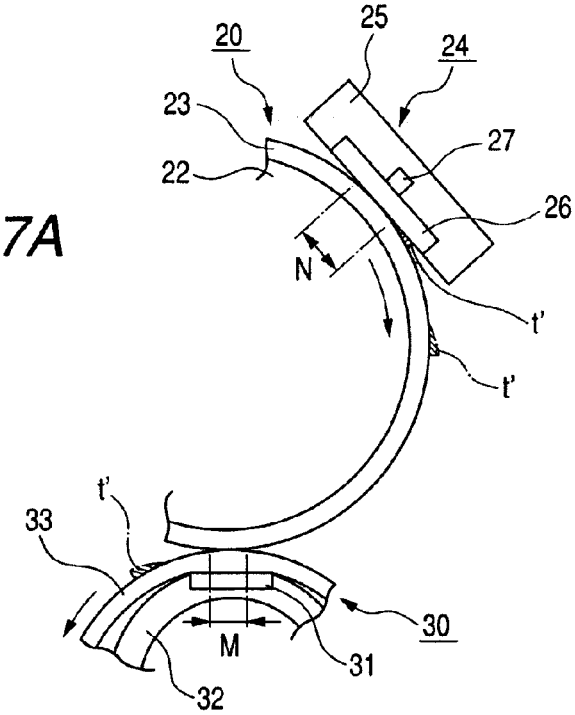
FIG. 7A is a view showing an operation of transferring a toner, deposited in a fixing nip portion, from the fixing roller to a pressure member.

A detected temperature of the heater 26 is entered from the temperature detector 27 in such state, and, when the detected temperature reaches a predetermined temperature T3 low than the aforementioned fusing temperature of the toner, the rotation controller 36 turns off the main motor 35 thereby rotating the fixing roller 20 clockwise (conveying direction of the recording material) as shown in FIG. 7A. The temperature T3 is so selected as to be lower than the fusing temperature of the toner, but higher than a temperature at which the toner t' completely sticks to the surface of the fixing roller 20. Thus the temperature T3 is preferably lower than the toner fusing temperature but equal to or higher than a toner softening temperature, so that the toner t' is in a half-fused state when the fixing roller 20 starts rotation. In the present embodiment, the start of rotation of the fixing roller 20 after cooling is managed by the temperature of the heater 26 (namely, temperature detected by the temperature detector 27) in such a manner that the rotation is started when the temperature T3 is reached, but it may also be managed by a time from the start of cooling. A rotation angle (rotation amount) in the cleaning mode need only that a circumferential area of the fixing roller constituting the heating nip portion N can reach the fixing nip portion M in the cleaning mode. An angle of 360° at maximum is preferable, since a larger rotation amount is almost meaningless.

The toner t' supported on the fixing roller 20 is carried to the fixing nip portion (conveying nip portion) M.

The sliding film 33 of the backup means 30 has a very low heat capacity, and does not receive a heat supply from the fixing roller 20 while the heater 26 is heated and cooled in the cleaning mode. Therefore, when the toner t' supported on the fixing roller 20 reaches the fixing nip portion M, the surface of the film 33 has a temperature lower than that of the area of the fixing roller 20, heated in the cleaning mode. Consequently, the toner t' supported on the fixing roller 20, upon arriving at the fixing nip portion M, is transferred, in the fixing nip portion M, from the fixing roller 20 to the surface of the lower temperature of the film 33. In this operation, the fixing roller 20 is rotated at least by an angle necessary for carrying the toner t' from the position of the heater 26 to the fixing nip portion M, and the rotation controller 36 turns off the main motor 35 thereby terminating the control mode.

Upon completion of the control mode, the image forming apparatus enters a stand-by state.

Figure 11:
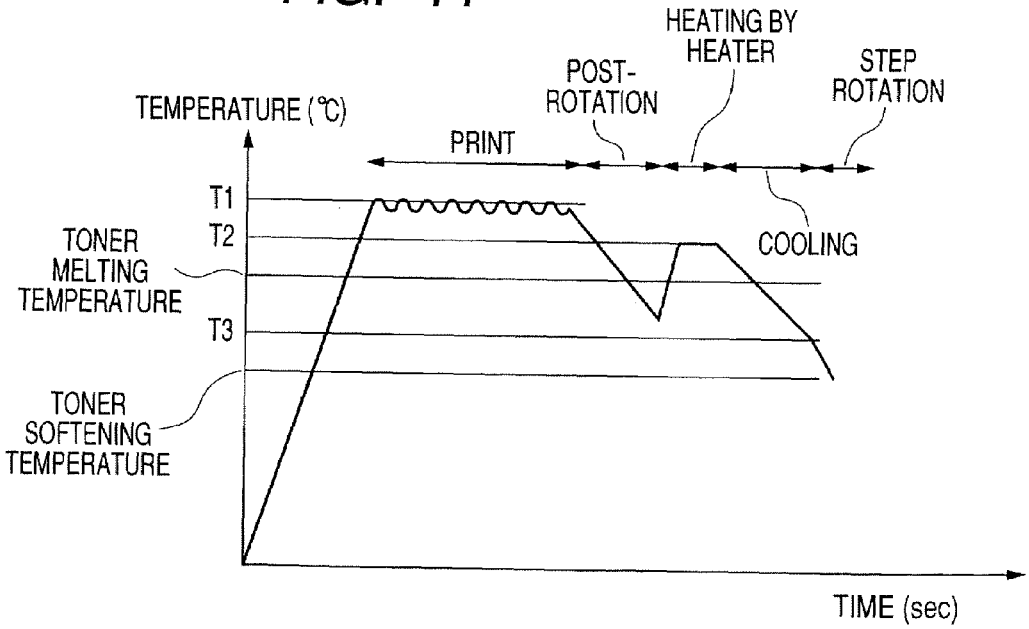
FIG. 11 is a view showing an operation of a variation of the embodiment 1.

As regards the set temperature T1 of the heater in the fixing step and the set temperature T2 in the cleaning mode, FIG. 6 shows a relationship T1<T2, but such relationship is not restrictive and there may be assumed a relationship T1=T2, or T1>T2 as shown in FIG. 11, as long as the temperature T2 is at least equal to the fusing temperature of the toner.

Figure 7B:
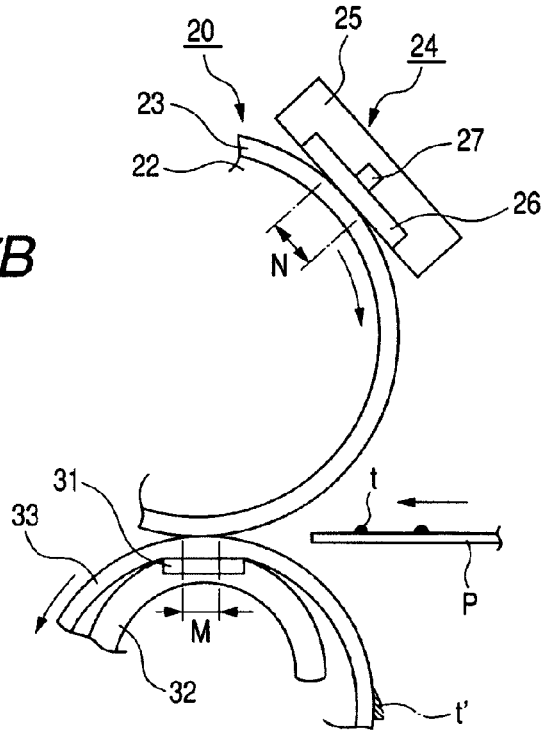
FIG. 7B is a view showing an operation of transferring a toner, transferred onto the pressure member, onto a recording material.

When a print start signal is entered in the aforementioned state where the toner t' is deposited on the film 33, a next printing operation is initiated after a initial rotation step, and a recording material P is introduced into the fixing nip portion M of the heat fixing apparatus 8 as shown in FIG. 7B. In the initial rotation step, the heater 26 generates heat to heat the fixing roller 20, and, in the fixing nip portion M, the film 33 is also heated by the heat received from the fixing roller 20. As the recording material P is at the normal temperature, the toner t' deposited on the surface of the film 33 is transferred, in the fixing nip portion M, from the surface of the film 33 onto a surface (image non-recording surface) of the recording material P, at the side of the film 33, having a temperature lower than that of the film 33, and is discharged together with the recording material P.

Thus, the cleaning mode (control mode) of the present embodiment allows to discharge the toner, deposited in the heater 26, together with the recording material P at the printing operation.

The aforementioned control mode is preferably executed after a printing of several to several tens of recording materials P. In such case, the offset toner t', sticking to the external surface of the fixing roller 20 at the fixing nip portion M and deposited at the downstream side of the heating nip portion N of the heater 26, is of a visually unnoticeable small amount as it is of a level accumulated by passing several to several tens of recording materials P through the fixing nip portion M. Therefore, the toner t', supported on the film 33 and discharged by deposition on the rear surface of the recording material P, is naturally also of a visually unnoticeable level.

Figure 2:
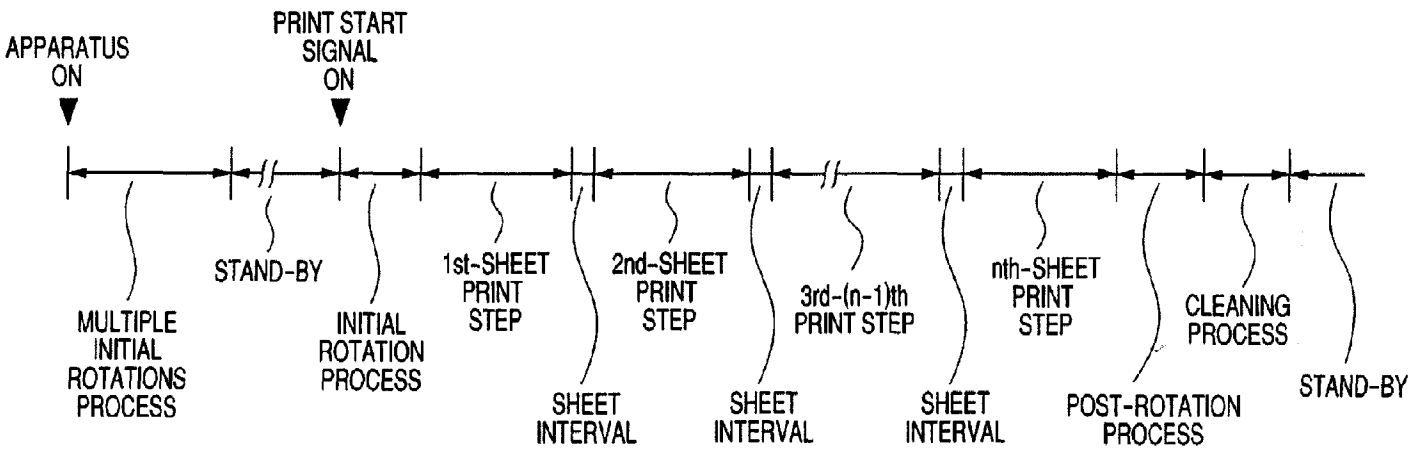
FIG. 2 is a view showing an operation sequence of an image forming apparatus of an embodiment 1.

The control mode is not limited to after the post-rotation step but may also be executed, for example, after the pre multi-rotation step, the stand-by state or the initial rotation step shown in FIG. 2.

In the heat fixing apparatus of the present embodiment, the direction of rotation of the fixing roller 20, for carrying the toner t' supported on the fixing roller 20 by turning off the temperature control of the heater 26 to the fixing nip portion M, may be same as the conveying direction of the recording material P (clockwise direction) as explained in the foregoing embodiment or may be opposite to the conveying direction of the recording material P (namely counterclockwise direction). It is preferably same as the conveying direction of the recording material. However, the direction of rotation of the fixing roller 20 for transferring the toner t', transferred onto the film 33, to the recording material P, is same as the conveying direction of the recording material P.

6) Evaluation

Effect of the cleaning sequence was confirmed by executing a printing operation with the above-described heat fixing apparatus. This evaluation utilized a conveying speed for the recording material (hereinafter called process speed) of 250 mm/sec, a control temperature T1 of the heater 26 of 230° C. in the printing operation, and a control temperature T2 of 180° C. in the cleaning sequence. The cleaning sequence was executed with a heating time of 3 seconds, a cooling time thereafter of 6 seconds and a stepped rotation thereafter of the fixing roller 20 for carrying the toner deposited on the fixing roller to the fixing nip portion M.

This evaluation employed a monochromatic crushed toner with a softening temperature of 60 to 70° C. and a fusing temperature of 90 to 100° C. Therefore, the aforementioned cooling time of 6 seconds is a time required by the heater 26 to cool down to about 80° C. As the recording material, there were employed paper sheets having a relatively rough surface (rough paper) of a letter size, with a basis weight of 90 g/m$^2$. In order to achieve satisfactory fixation on this recording material with a process speed of 250 mm/sec, it was necessary to maintain the fixing nip portion M at a temperature of 180° C., corresponding to a heater temperature of 230° C.

In the cleaning sequence after the post-rotation step, the heater is controlled at 180° C. for 3 seconds to fuse the toner t' sticking to the surface of the heater, and the heating nip portion N becomes about 80° C. by a cooling of 6 seconds thereafter. After such cooling time, the toner t' sticking on the fixing roller is carried by a stepped rotation to the fixing nip portion M, in which the toner t' is then transferred onto the film 33 of an even lower surface temperature. The toner t' transferred onto the film 33 is then deposited and discharged on the non-printing side of the recording material introduced in a printing operation. As this cleaning sequence is executed after the completion of a printing operation (in case of a printing instruction for plural prints, it is executed after the completion of printing of the instructed prints), and as the toner t' is a very small amount (deposited toner being very small in a continuous printing operation of about 500 prints), such toner is completely acceptable when deposited on the recording material.

In an intermittent sheet-passing durability test (2 sheet/minute) without the cleaning sequence after the printing operation, an image defect by the offset toner deposited on the heater surface was caused after about 2,000 prints. On the other hand, an intermittent sheet-passing durability test with the cleaning sequence of the present embodiment did not show an image defect even after 20,000 prints.

The cleaning sequence of the present embodiment allows to effectively decrease the amount of the offset toner sticking to the heater, even in the presence of fluctuations, for example, in the roughness of the surfacial coating on the heater 26, thereby dispensing with an unnecessary precision on the surface coating of the heater to enable an improvement in the production yield of the heater and a cost reduction therein.

Second Embodiment

In the following, there will be explained a second embodiment of the present invention. In the present embodiment, the configuration of the entire image forming apparatus is similar to that in the foregoing first embodiment and will not be explained further.

Figure 8:
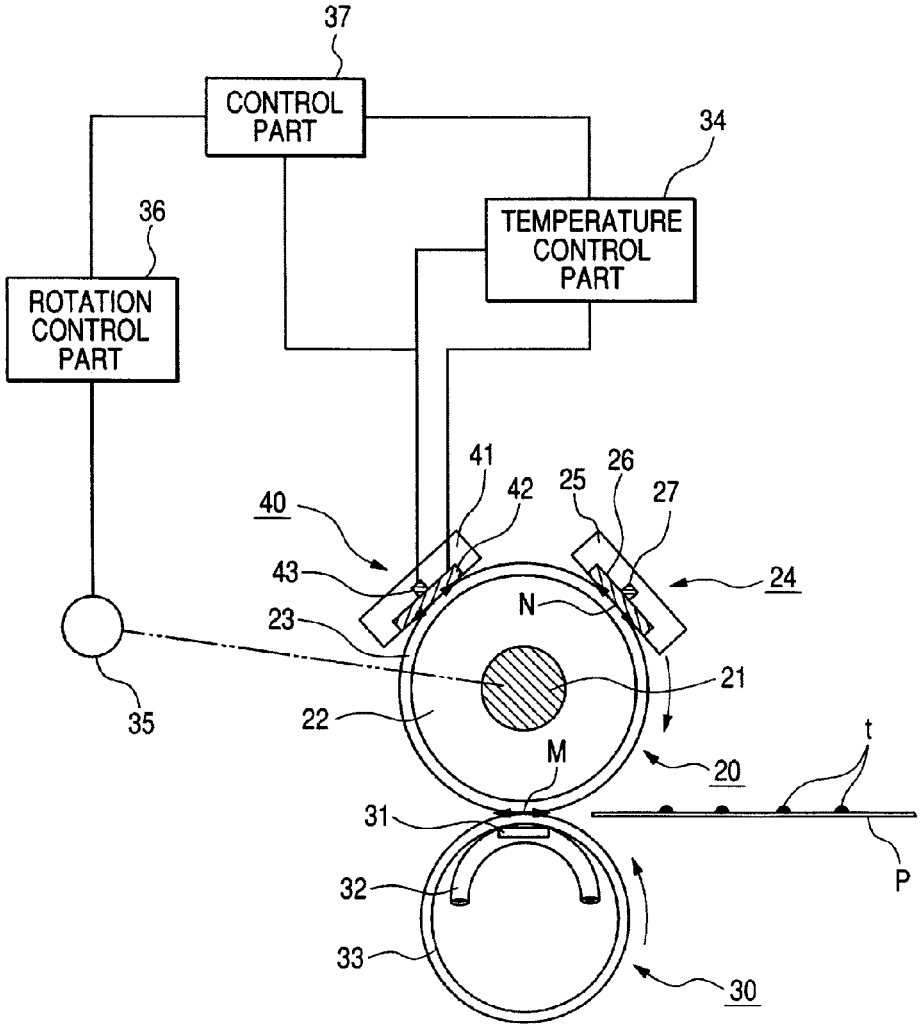
FIG. 8 is a view showing an operation sequence of an image forming apparatus of an embodiment 2.

FIG. 8 shows the configuration of the heat fixing apparatus of the present embodiment. The heat fixing apparatus of the present embodiment is different from the first embodiment in plural heating members, for heating the fixing roller 20 with two heating members, namely the aforementioned heating member 24 and another heating member 40, positioned in the upstream side thereof in the rotating direction of the fixing roller 20. Other configurations are similar to those in the first embodiment and will not, therefore, be explained further. The heating member 40 includes a heat insulating stay holder 41, a heater 42 and a temperature detector 43.

In case of employing plural (two in the present embodiment) heating members 24, 40, the offset toner is deposited principally on the heater surface positioned at the upstream side of the heating member 24, in the rotating direction of the fixing roller 20. In the present embodiment, it is deposited on the surface of the heater 42 of the heating member 40.

1) Control Mode

Figure 9A:
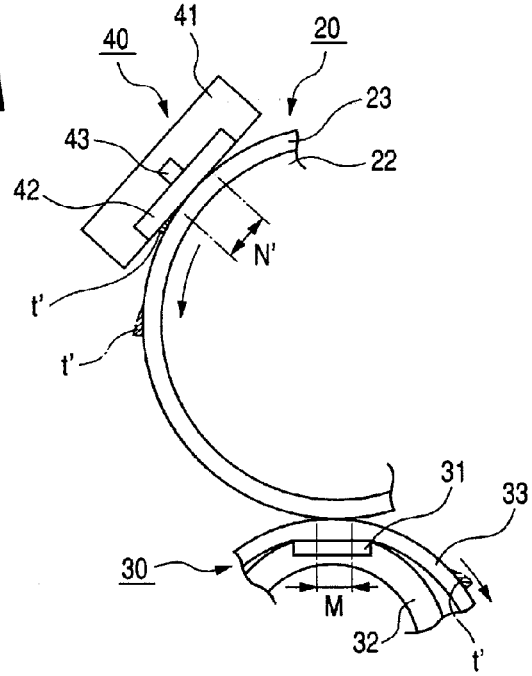
FIG. 9A is a schematic view showing an operation of transferring a toner, deposited in a heating nip portion, from the fixing roller to the pressure member.

In the present embodiment, a control mode similar to that of the control mode (cleaning sequence) of the first embodiment, shown in FIG. 6, is executed by the controller 37. In the apparatus of the present embodiment, the fixing roller 20 is heated by both heaters in the printing operation (image heating), but, in the cleaning mode, heating is not executed in the heater 26 which is at the downstream side in the rotating direction of the fixing roller 20 in the printing operation (namely, recording material conveying direction). In case of employing three or more heaters, heating may be executed in the most upstream heater only. In the control mode of the present embodiment, after the toner t' is transferred from the surface of the heater 42 onto the surface of the fixing roller 20, the fixing roller 20 has to be rotated in a (counterclockwise) direction opposite to the recording material conveying direction, as shown in FIG. 9A. If the fixing roller 20 is rotated in the recording material conveying direction, the toner t' transferred from the heater 42 to the surface of the fixing roller 20 sticks to the surface of the heater 26 of the heating member 24 shown in FIG. 8 and cannot reach the pressure member 30, thus being unable to be discharged by the recording material P. Therefore, in the cleaning operation of the present embodiment, the fixing roller 20 is rotated in a direction opposite to the conveying direction for the recording material P, thereby transferring the toner t' in the fixing nip portion M from the fixing roller 20 onto the pressure member 30 (film 33). In this case, the fixing roller 20 is rotated by a predetermined angle required to transfer the toner t' from the heater 42 to the pressure member 30, and the rotation controller 36 thereafter turns off the main motor 35 thereby terminating the control mode.

Upon completion of the control mode, the image forming apparatus enters a stand-by state.

Figure 9B:
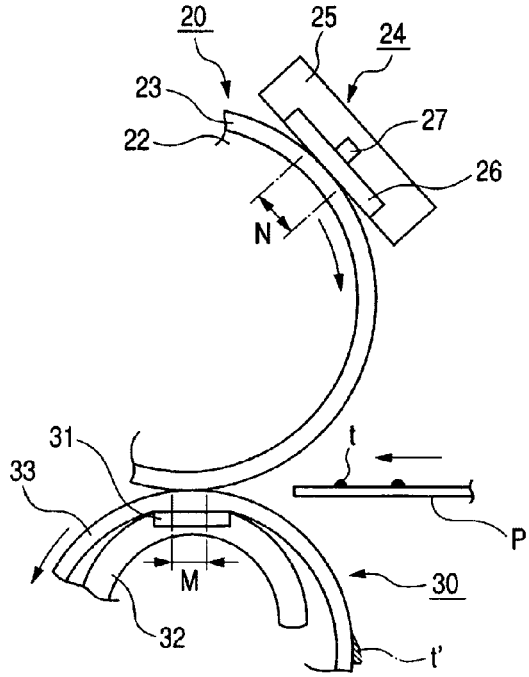
FIG. 9B is a view showing an operation of transferring a toner, transferred onto the pressure member, onto a recording material.
Figure 10:
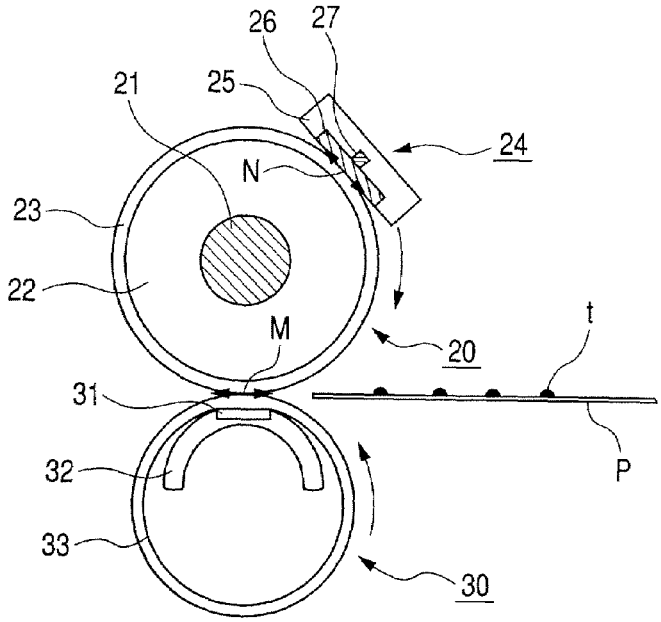
PRIOR ART FIG. 10
FIG. 10 is a schematic view showing a configuration of a prior heating fixing apparatus.

When a print start signal is entered in the stand-by state, a next printing operation is initiated after a initial rotation step, and a recording material P is introduced into the fixing nip portion M of the heat fixing apparatus 8 as shown in FIG. 9B. As the recording material P is at the normal temperature, the toner t' deposited on the surface of the pressure member 30 is transferred from the surface of the pressure member onto a surface (image non-recording surface) of the recording material P, at the side of the pressure member, and is discharged together with the recording material P.

2) Evaluation

In an intermittent sheet-passing durability test (2 sheet/minute) without the aforementioned cleaning sequence after the printing operation, an image defect by the offset toner deposited on the heater surface was caused after about 3,000 prints. An increase in the number of prints before causing the image defect, in comparison with that in the first embodiment, results from a fact that the presence of two heating members increases an accumulating capacity for the offset toner. On the other hand, an intermittent sheet-passing durability test with the cleaning sequence of the present embodiment did not show an image defect even after 30,000 prints.

OTHER EMBODIMENTS

1) The image heating apparatus of the present invention is applicable, not only to the heat fixing apparatus shown in the embodiments but also to various means or apparatus for heating a recording material bearing an image, such as an image heating apparatus for improving a surface property such as gloss by heating the recording material P bearing an image, or an image heating apparatus for temporary image fixation.

2) For forming an unfixed toner image on the recording material P, there can be employed any image forming process such as an electrophotographic process or an electrostatic recording process of direct type or indirect type.

The present invention is not limited to the aforementioned embodiments but is subject to any and all modifications within the technical concept thereof.

This application claims priorities from Japanese Patent Application Nos. 2004-026238 filed on Feb. 3, 2004 and 2005-011710 filed on Jan. 19, 2005, which are hereby incorporated by reference herein.

What is claimed is:

1. An image heating apparatus for heating a toner image formed on a recording material, comprising:

a rotatable member;

heating means for heating an outer peripheral surface of said rotatable member, said heating means including a heater for forming a heating nip portion in cooperation with said rotatable member;

back-up means for forming a conveying nip portion in cooperation with said rotatable member, the conveying nip portion conveying the recording material; and control means for controlling a temperature of said heater and a rotation of said rotatable member;

wherein said apparatus has a cleaning mode to remove toner from said heating means, wherein said control means, in the cleaning mode, starts energizing said heater to dissipate heat in a condition that said rotatable member stops and afterward stops energizing said heater, and wherein said control means rotates said rotatable member until a part which forms a heating nip portion in a peripheral direction of said rotatable member reaches the conveying nip portion.

2. An image heating apparatus according to claim 1, wherein the cleaning mode is automatically executed after a heating step to heat the toner image on a recording material.

3. An image heating apparatus according to claim 1, wherein said heater is heated at a temperature equal to or higher than a melting temperature of toner in the cleaning mode.

4. An image heating apparatus according to claim 1, wherein, when said rotatable member starts rotating in the cleaning mode, a temperature of said heater is higher than a melting temperature of toner.

5. An image heating apparatus according to claim 4, wherein, when said rotatable member starts rotating in the cleaning mode, a temperature of said heater is higher than a softening temperature of toner.

6. An image heating apparatus according to claim 1, wherein, a rotation direction of said rotatable member in the cleaning mode is the same as a rotation direction of said rotatable member when toner on the recording material is heated.

7. An image heating apparatus according to claim 1, wherein, said apparatus further comprises a plurality of heaters in a peripheral direction of said rotatable member.

8. An image heating apparatus according to claim 7, wherein, in the cleaning mode, only the heater provided in the uppermost stream of a rotation direction is heated.

9. An image heating apparatus according to claim 8, wherein a rotation direction of said rotatable member in the cleaning mode is opposite to a rotation direction of said rotatable member when a toner image on the recording material is heated.

10. An image heating apparatus according to claim 1, wherein said back-up means comprising:

a sliding member to form the conveying nip portion with said rotatable member; and a flexible sleeve whose internal peripheral surface contacts said sliding member and outer peripheral surface contacts an outer peripheral surface of said rotatable member.

11. An image heating apparatus according to claim 1, wherein said rotatable member includes an elastic layer whose thermal conductivity is equal to or less than 0.15 W/m·k and specific gravity is equal to or less than 0.85.

12. An image heating apparatus according to claim 1, wherein said heater has a ceramic substrate and a heat-generating resistor formed on the ceramic substrate.

* * * * *

UNITED STATES PATENT AND TRADEMARK OFFICE

CERTIFICATE OF CORRECTION

PATENT NO. : 7,190,914 B2
APPLICATION NO. : 11/046836
DATED : March 13, 2007
INVENTOR(S) : Nihonyanagi et al.

It is certified that error appears in the above-identified patent and that said Letters Patent is hereby corrected as shown below:

On the cover page,

[*] Notice: Subject to any disclaimer, the term of this patent is extended or adjusted under 35 USC 154(b) by (69) days Delete the phrase "by 69" and insert -- by 147 days--

Signed and Sealed this

Ninth Day of October, 2007

JON W. DUDAS
*Director of the United States Patent and Trademark Office*

UNITED STATES PATENT AND TRADEMARK OFFICE

CERTIFICATE OF CORRECTION

PATENT NO. : 7,190,914 B2
APPLICATION NO. : 11/046836
DATED : March 13, 2007
INVENTOR(S) : Koji Nihonyanagi et al.

It is certified that error appears in the above-identified patent and that said Letters Patent is hereby corrected as shown below:

COLUMN 1
Line 55, “heating” should read --heat--.

COLUMN 2
Line 53, “heating” should read --heat--.
Line 54, “FIG. 2,” should read --FIG. 3,--; and “line B—B” should read --line 4—4--.
Line 55, “FIG. 2;” should read --FIG. 3;--.

COLUMN 5
Line 20, “B—B” should read --4—4--.
Line 33, “following” should read --the following--.
Line 42, “case” should read --the case of--.

COLUMN 6
Line 41, “diamon-like” should read --diamond-like--.

COLUMN 7
Line 40, “is” should read --are--.
Line 50, “sliding film 31” should read --sliding film 33--.

COLUMN 8
Line 29, “heat” should read --heating--.

COLUMN 9
Line 42, “low” should read --lower--.

UNITED STATES PATENT AND TRADEMARK OFFICE

CERTIFICATE OF CORRECTION

PATENT NO. : 7,190,914 B2
APPLICATION NO. : 11/046836
DATED : March 13, 2007
INVENTOR(S) : Koji Nihonyanagi et al.

It is certified that error appears in the above-identified patent and that said Letters Patent is hereby corrected as shown below:

COLUMN 12
Line 62, "a initial" should read --an initial--.

COLUMN 14
Line 39 claim 10, "comprising:" should read --comprises:--.

Signed and Sealed this

Twenty-seventh Day of May, 2008

JON W. DUDAS
*Director of the United States Patent and Trademark Office*